US009932722B2

(12) United States Patent
Wu

(10) Patent No.: US 9,932,722 B2
(45) Date of Patent: Apr. 3, 2018

(54) SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 376 days.

(21) Appl. No.: 14/695,194

(22) Filed: Apr. 24, 2015

(65) Prior Publication Data

US 2015/0225929 A1 Aug. 13, 2015

Related U.S. Application Data

(63) Continuation of application No. PCT/JP2013/071160, filed on Aug. 5, 2013.

(30) Foreign Application Priority Data

Oct. 30, 2012 (JP) ..... 2012-238975

(51) Int. Cl.

| | |
|---|---|
| ***F15B 21/14*** | (2006.01) |
| ***E02F 9/22*** | (2006.01) |
| ***E02F 9/12*** | (2006.01) |
| ***F15B 1/02*** | (2006.01) |
| ***F15B 11/16*** | (2006.01) |

(52) U.S. Cl.

CPC ..... *E02F 9/2217* (2013.01); *E02F 9/123* (2013.01); *F15B 1/024* (2013.01); *F15B 11/16* (2013.01); *F15B 21/14* (2013.01); *F15B 2201/411* (2013.01); *F15B 2211/205* (2013.01); *F15B 2211/212* (2013.01); *F15B 2211/625* (2013.01); *F15B 2211/7058* (2013.01); *F15B 2211/88* (2013.01)

(58) Field of Classification Search

CPC ..... F15B 1/024; F15B 21/14; E02F 9/2217
USPC ..... 60/414, 416
See application file for complete search history.

(56) References Cited

U.S. PATENT DOCUMENTS 4,674,280 A * 6/1987 Stuhr ..... F15B 1/02 180/165
4,731,997 A * 3/1988 Hagin ..... B60K 6/12 60/405

(Continued)

FOREIGN PATENT DOCUMENTS

CN 102518169 6/2012
JP S56-170301 U 4/1981

(Continued)

OTHER PUBLICATIONS

International Search Report dated Nov. 12, 2013 (PCT/JP2013/071159).

(Continued)

*Primary Examiner* — Thomas E Lazo
(74) *Attorney, Agent, or Firm* — IPUSA, PLLC

(57) ABSTRACT

A shovel may be provided with a main pump, hydraulic actuators including a swing hydraulic motor, a control valve that controls a flow of a working oil between the main pump and the hydraulic actuators, and two accumulators connected between the swing hydraulic motor and the control valve. The two accumulators can respectively release the working oil at an upstream of the main pump.

9 Claims, 10 Drawing Sheets

(56) References Cited

U.S. PATENT DOCUMENTS

| | | | | |
|---|---|---|---|---|
| 6,981,371 | B2 * | 1/2006 | Imanishi | E02F 9/2225 60/420 |
| 7,269,944 | B2 * | 9/2007 | Zhang | E02F 9/2217 60/414 |
| 7,823,379 | B2 * | 11/2010 | Hamkins | E02F 9/2217 60/414 |
| 7,908,852 | B2 * | 3/2011 | Zhang | E02F 9/2217 60/414 |
| 8,061,764 | B2 * | 11/2011 | Meier | B62D 33/0617 180/89.14 |
| 8,776,511 | B2 * | 7/2014 | Zhang | F15B 21/14 60/410 |
| 2003/0115863 | A1 | 6/2003 | Holt et al. | |
| 2007/0074509 | A1 | 4/2007 | Zhang et al. | |
| 2009/0217653 | A1 | 9/2009 | Zhang et al. | |

FOREIGN PATENT DOCUMENTS

| | | |
|---|---|---|
| JP | S61-013004 U | 1/1986 |
| JP | 2000-204604 | 7/2000 |
| JP | 2003-222105 | 8/2003 |
| JP | 2005-003183 | 1/2005 |
| JP | 2011-514954 | 5/2011 |
| JP | 2012-102881 | 5/2012 |

OTHER PUBLICATIONS

International Search Report dated Nov. 12, 2013 (PCT/JP2013/071160).
International Search Report dated Nov. 12, 2013 (PCT/JP2013/071161).

* cited by examiner

SHOVEL

RELATED APPLICATION

This application is a continuation application of International Application No. PCT/JP2013/071160 filed on Aug. 5, 2013 and designated the U.S., which is based upon and claims the benefit of priority of Japanese Patent Application No. 2012-238975, filed on Oct. 30, 2012, the entire contents of which are incorporated herein by reference.

BACKGROUND

Technical Field

The present invention relates to a shovel provided with an accumulator.

Description of Related Art

In related art, there is a known swing hydraulic motor control system that uses a single accumulator.

In this swing hydraulic motor control system, in order to recover kinetic energy of inertia operation of a swing hydraulic motor as hydraulic energy when decelerating the swing hydraulic motor, a working oil exited from the swing hydraulic motor is stored in an accumulator. In addition, in this swing hydraulic motor control system, in order to reuse the recovered oil energy as kinetic energy when accelerating the swing hydraulic motor, the working oil stored in the accumulator is supplied to the swing hydraulic motor.

However, this swing hydraulic motor control system is configured to use a single accumulator, and for this reason, a large-capacity accumulator capable of storing the working oil flowing out of the swing hydraulic motor at a time of a swing deceleration needs to be provided. Consequently, a relatively large amount of the working oil is required to increase the pressure of the accumulator. As a result, in a case in which the swing acceleration is performed in a state where the pressure of the accumulator is low due to an insufficient amount of the working oil stored in the accumulator at the time of the swing deceleration, the working oil accumulated in the accumulator cannot be released with respect to the swing hydraulic motor.

SUMMARY

According to one embodiment of the present invention, there is provided a shovel including a main pump; hydraulic actuators including a swing hydraulic motor; a control valve configured to control a flow of a working oil between the main pump and the hydraulic actuators; and a plurality of accumulators connected between the swing hydraulic motor and the control valve, and configured to accumulate the working oil on a braking side of the swing hydraulic motor at a time of a swing deceleration, wherein the plurality of accumulators respectively include separate on-off valves, the on-off valves open and close according to a pressure of the working oil of the swing hydraulic motor, and one of the plurality of accumulators accumulates the working oil from the swing hydraulic motor at a timing different from another one of the plurality of accumulators.

DETAILED DESCRIPTION

A description will hereinafter be given of embodiments of the present invention with reference to the drawings.

In view of the related art described above, it is desirable to provide a shovel that can efficiently perform the accumulation and release of the accumulator.

Embodiment

Figure 1:
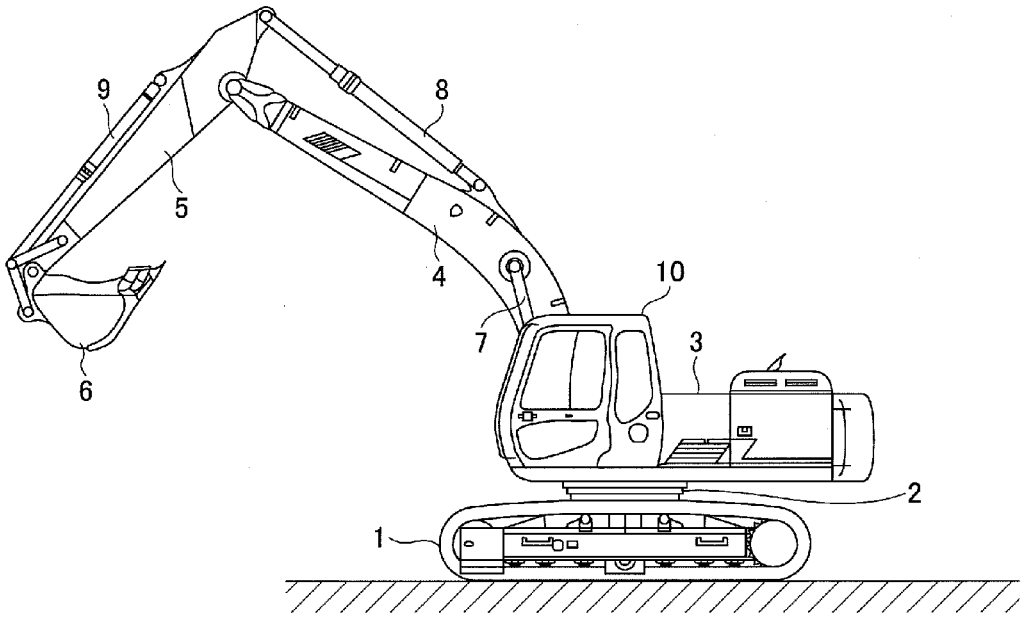
FIG. 1 is a side view of a hydraulic shovel according to one embodiment of the present invention.

FIG. 1 is a side view of a hydraulic shovel according to one embodiment of the present invention.

An upper structure 3 can be mounted on a lower structure of the hydraulic shovel via a slewing mechanism 2. A boom 4 can be mounted on the upper structure 3. An arm 5 can be mounted on a tip end of the boom 4, and a bucket 6 can be mounted on a tip end of the arm 5. The boom 4, the arm 5, and the bucket 6 may form an attachment. The boom 4, the arm 5, and the bucket 6 can be respectively driven hydraulically by a boom cylinder 7, an arm cylinder 8, and a bucket cylinder 9 which are hydraulic cylinders. A cabin 10 can be provided on the upper structure 3, and a driving source, such as an engine or the like, can also be provided on the upper structure 3.

Figure 2:
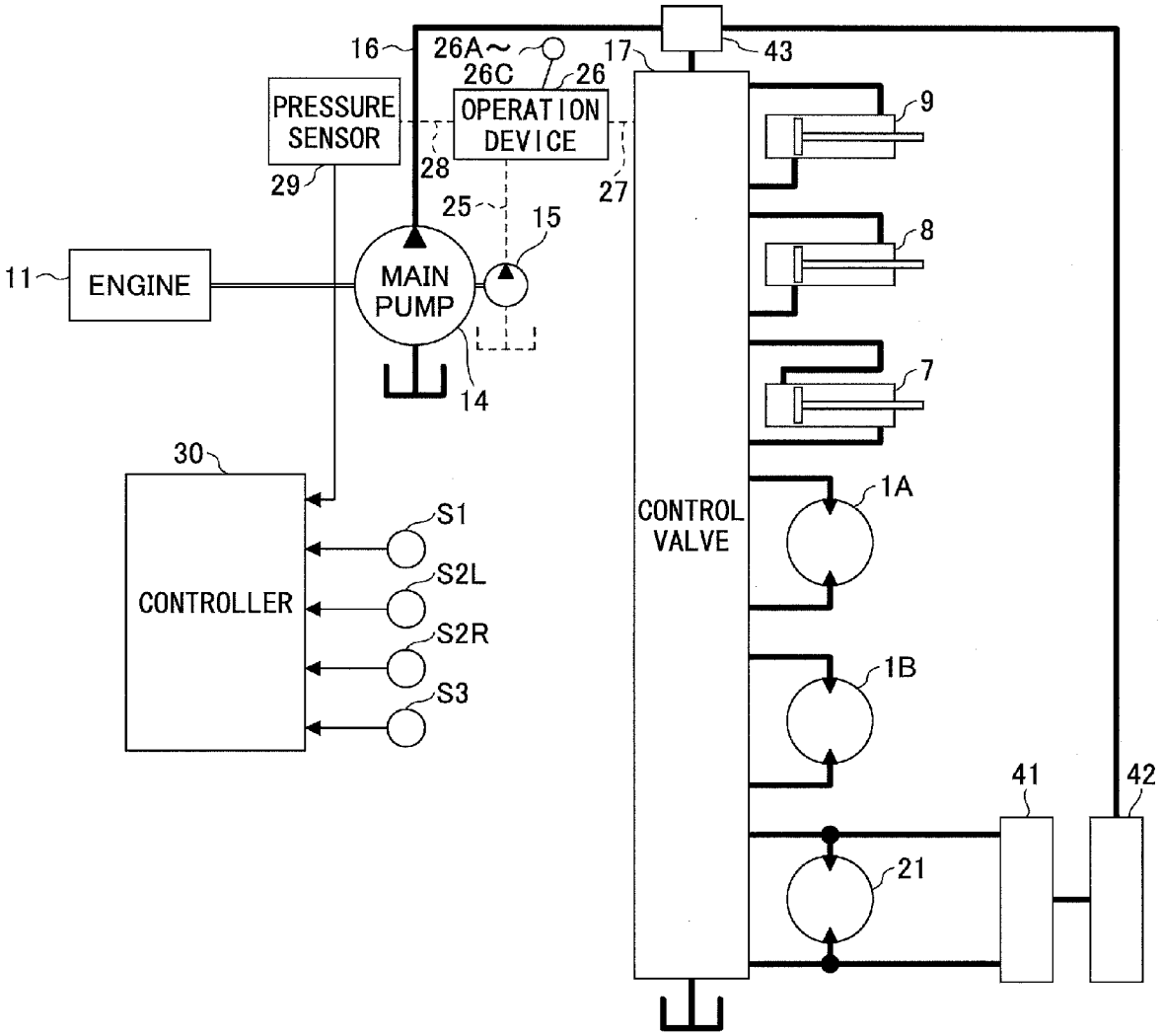
FIG. 2 is a block diagram illustrating a configuration of a driving system of the hydraulic shovel of FIG. 1.

FIG. 2 is a block diagram illustrating a configuration of a driving system of the hydraulic shovel of FIG. 1. In FIG. 2, a mechanical power system is indicated by a double line, a high-pressure hydraulic line is indicated by a bold solid line, a pilot line is indicated by a broken line, and an electrical drive and control system is indicated by a thin solid line.

A main pump 14 and a pilot pump 15, which may form a hydraulic pump, can be connected to an output shaft of an engine 11 which may form a mechanical drive part. A control valve 17 can be connected to the main pump 14 via the high-pressure hydraulic line 16. In addition, an operation device 26 can be connected to the pilot pump 15 via a pilot line 25.

The control valve 17 can be a device for controlling a hydraulic system of the hydraulic shovel. Hydraulic actuators, such as hydraulic motors 1A (for the right side) and 1B (for the left side) of the lower structure 1, the boom cylinder 7, the arm cylinder 8, the bucket cylinder 9, a swing hydraulic motor 21, or the like can be connected to the control valve 17 via the high-pressure hydraulic line.

The operation device 26 may include a lever 26A, a lever 26B, and a pedal 26C. The lever 26A, the lever 26B, and the pedal 26C can be connected to each of the control valve 17 and a pressure sensor 29 via the hydraulic lines 27 and 28.

The pressure sensor 29 can be a sensor for detecting contents of an operation performed by an operator using the operation device 26. For example, the pressure sensor 29 may detect an operated direction and an operated amount of the lever or the pedal of the operation device 26 in the form of pressure, and output the detected value with respect to a controller 30. The contents of the operation performed from the operation device 26 may be detected using a sensor other than the pressure sensor.

The controller 30 may form a main control part for driving and controlling the hydraulic shovel. The controller 30 can be a device that is formed by a micro processor unit including a CPU (Central Processing Unit) and an internal memory, and can be realized by executing by the CPU a program for the driving and controlling, stored in the internal memory.

A pressure sensor S1 can be a sensor for detecting a discharge pressure of the main pump 14, and output the detected value with respect to the controller 30.

A pressure sensor S2L can be a sensor for detecting a pressure of a working oil on a side of a first port of the swing hydraulic motor 21, and outputs a detected value with respect to the controller 30.

A pressure sensor S2R can be a sensor for detecting a pressure of the working oil on a second port side of the swing hydraulic motor 21, and outputs a detected value with respect to the controller 30.

Pressure sensors S3 can be sensors for detecting pressures of the working oil in an accumulator part 42, and output detected values with respect to the controller 30.

A release and accumulation switching part 41 can be a hydraulic circuit element for controlling a flow of the working oil between the swing hydraulic motor 21 and the accumulator part 42.

The accumulator part 42 can be a hydraulic circuit element for accumulating excess working oil within the hydraulic circuit, and releasing the accumulated working oil according to needs. For example, the accumulator part 42 may accumulate the working oil of the swing hydraulic motor 21 at the time of a swing deceleration, and release the accumulated working oil at a time of a swing acceleration.

A detailed description of the release and accumulation switching part 41 and the accumulator part 42 will be given later.

Figure 3:
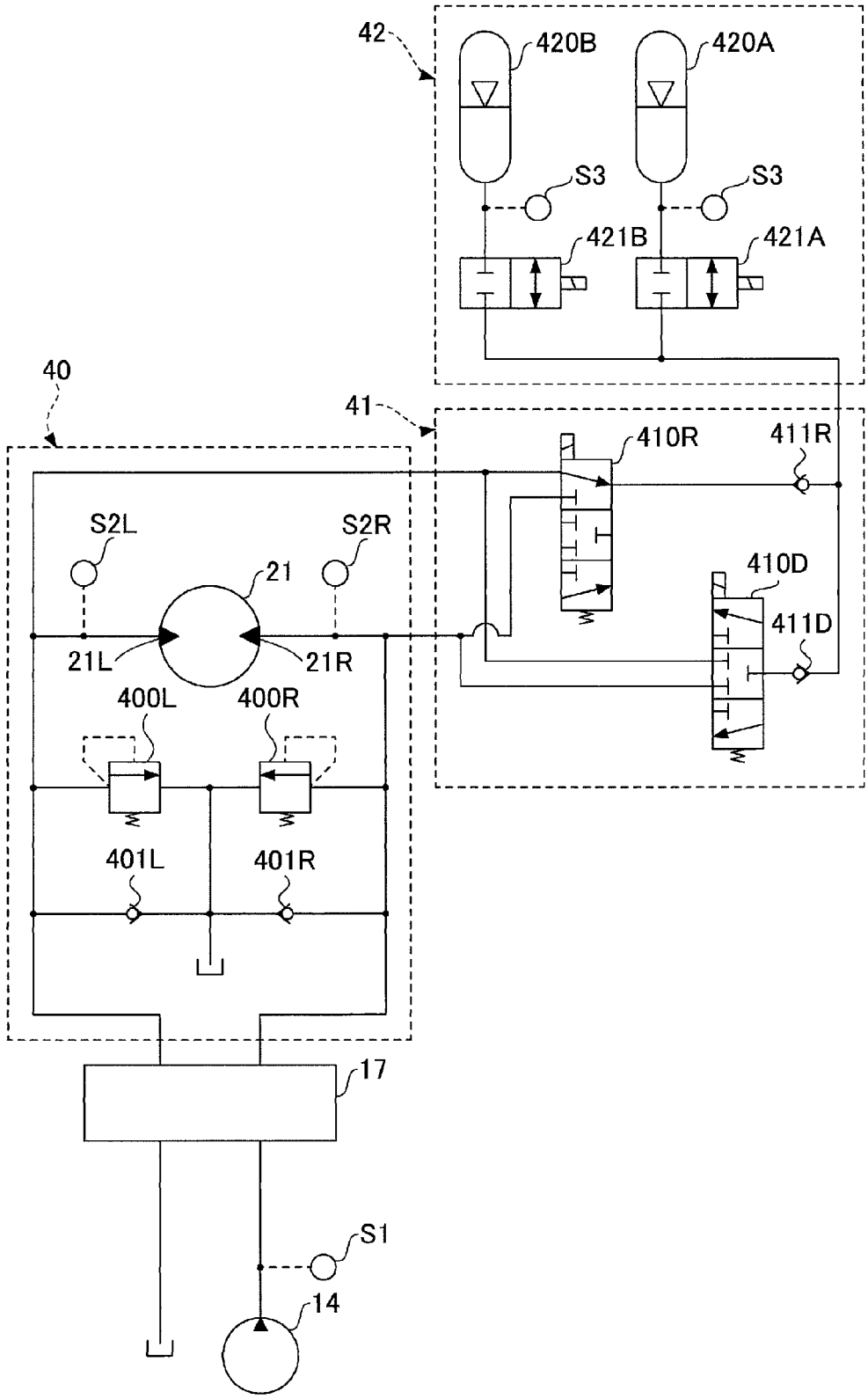
FIG. 3 is a diagram illustrating an example of a main configuration of a hydraulic circuit according to an embodiment.
Figure 4:
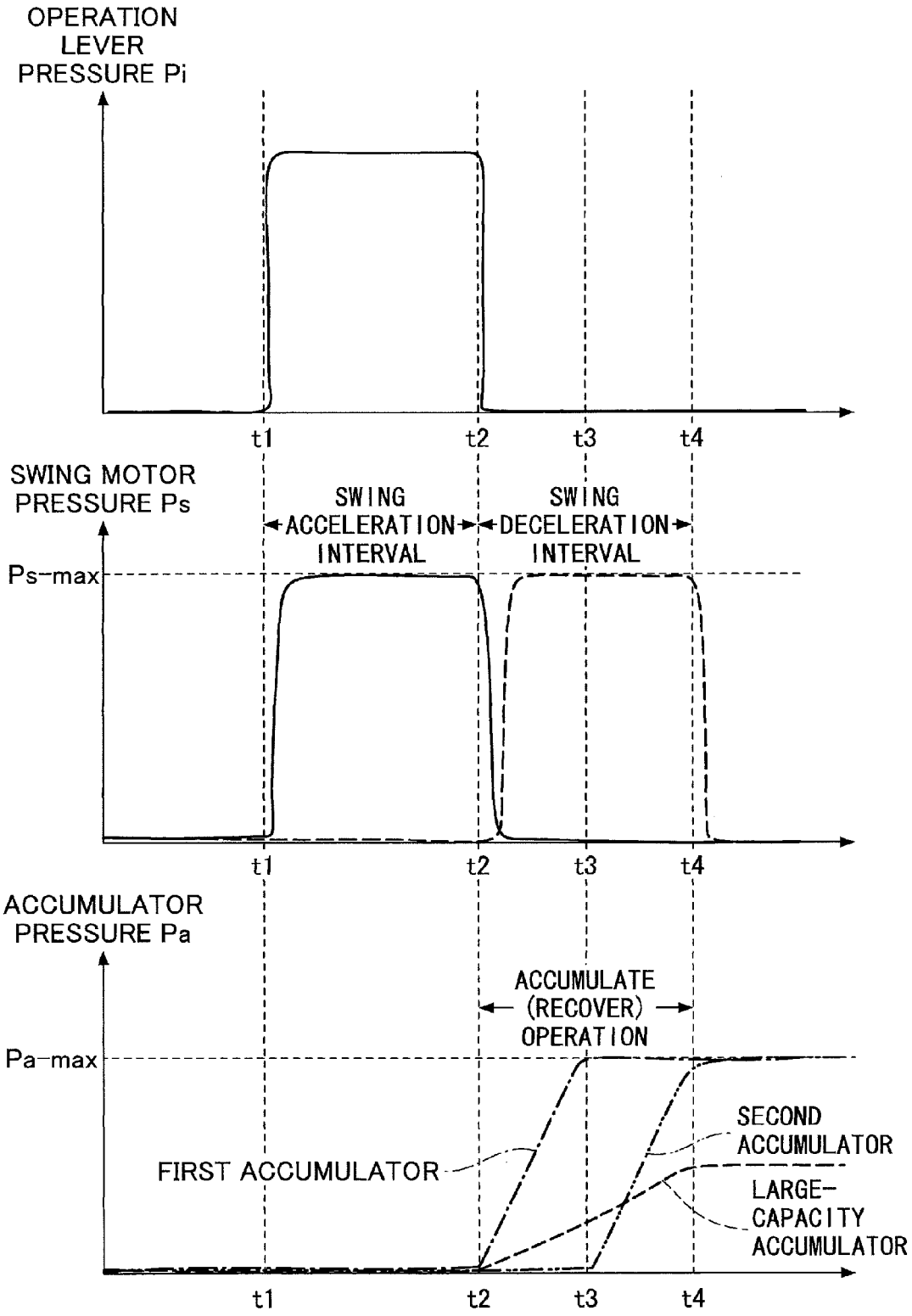
FIG. 4 is a diagram illustrating changes in various pressures with lapse of time, at times of accumulation and release of an accumulator according to the embodiment.
Figure 5:
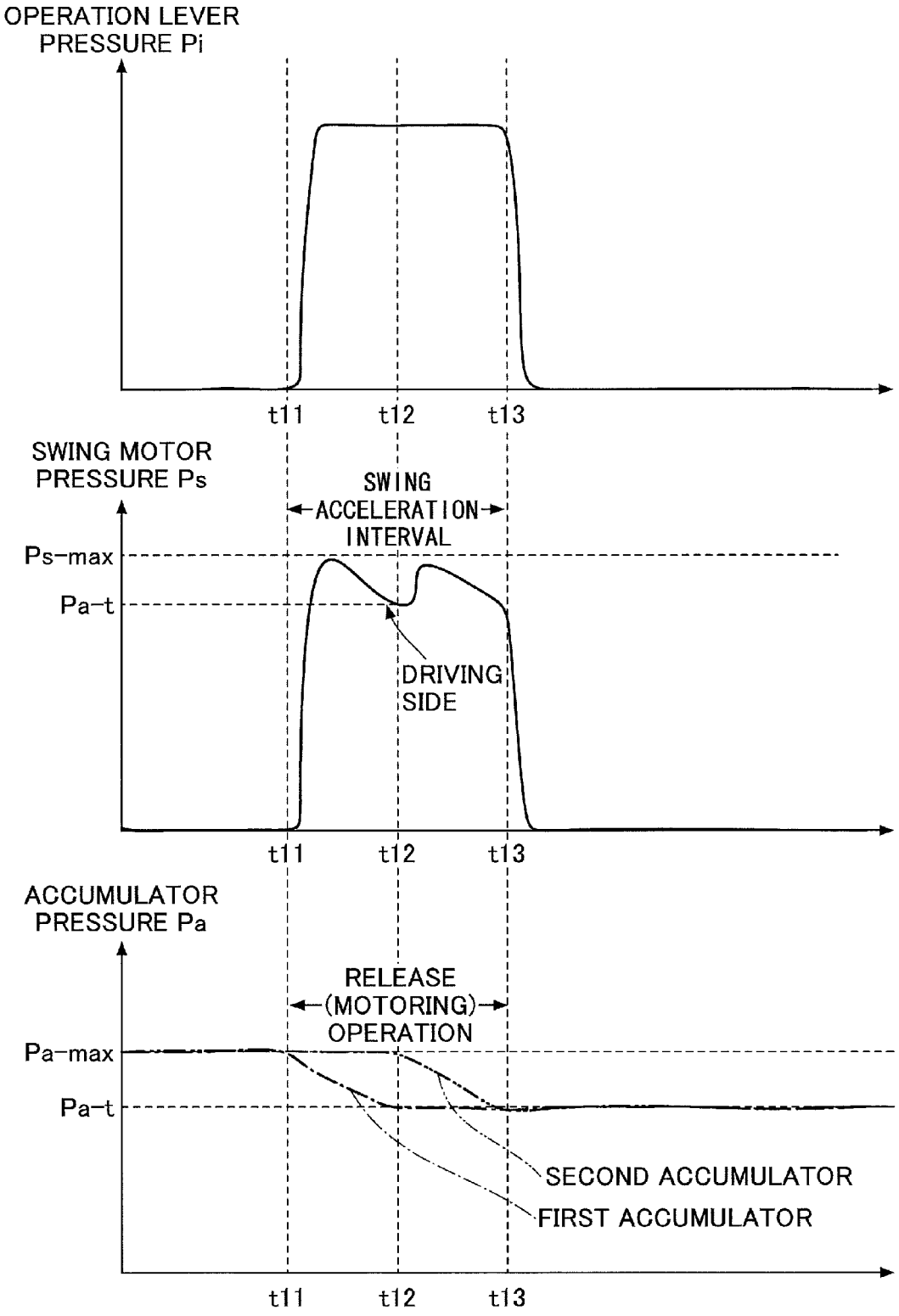
FIG. 5 is a diagram illustrating the changes in the various pressures with the lapse of time, at the time of the release of the accumulator according to the embodiment.

Next, a description will be given of the accumulation and release of the accumulator part 42 that is provided on the hydraulic shovel of FIG. 1, by referring to FIGS. 3 to 5. FIG. 3 is a diagram illustrating an example of a main configuration of a hydraulic circuit according to an embodiment, provided on the hydraulic shovel of FIG. 1. FIG. 4 is a diagram illustrating an example of changes in various pressures with lapse of time, at times of accumulation and release of the accumulator according to this embodiment. In addition, FIG. 5 is a diagram illustrating another example of the changes in the various pressures with the lapse of time, at the time of the release of the accumulator according to this embodiment.

The main configuration of the hydraulic circuit illustrated in FIG. 3 may mainly include a swing control part 40, the release and accumulation switching part 41, and the accumulator part 42.

The swing control part 40 may mainly include the swing hydraulic motor 21, relief valves 400L and 400R, and check valves 401L and 401R.

The relief valve 400L can be a valve for preventing the pressure of the working oil on the side of a first port 21L of the swing hydraulic motor 21 from exceeding a predetermined relief pressure. More particularly, the relief valve 400L may eject the working oil on the side of the first port 21L to a tank in a case in which the pressure of the working oil on the side of the first port 21L reaches the predetermined relief pressure.

Similarly, the relief valve 400R can be a valve for preventing the pressure of the working oil on the side of a second port 21R of the swing hydraulic motor 21 from exceeding a predetermined relief pressure. More particularly, the relief valve 400R may eject the working oil on the side of the second port 21R to the tank in a case in which the pressure of the working oil on the side of the second port 21R reaches the predetermined relief pressure.

The check valve 401L can be a valve for preventing the working oil on the side of the first port 21L from becoming less than a tank pressure. More particularly, the check valve 401L may supply the working oil within the tank to the side of the first port 21L in a case in which the pressure of the working oil on the side of the first port 21L decreases to the tank pressure.

Similarly, the check valve 401R can be a valve for preventing the working oil on the side of the second port 21R from becoming less than the tank pressure. More particularly, the check valve 401R may supply the working oil within the tank to the side of the second port 21R in a case in which the pressure of the working oil on the side of the second port 21R decreases to the tank pressure.

The release and accumulation switching part 41 can be a hydraulic circuit element for controlling a flow of the working oil between the swing control part 40 (swing hydraulic motor 21) and the accumulator part 42. In this embodiment, the release and accumulation switching part 41 may mainly include selector valves 410R and 410D, and check valves 411R and 411D.

The selector valve 410R can be a valve for controlling a flow of the working oil from the swing control part 40 to the accumulator part 42 at the time of an accumulation (recovery) operation of the accumulator part 42. In this embodiment, the selector valve 410R can be a 3-port 3-position selector valve, and may be formed by a solenoid valve that switches a valve position thereof according to a control signal from the controller 30. In addition, the selector valve 410R may be formed by a proportional valve that uses the pilot pressure. More particularly, the selector valve 410R can have a first position, a second position, and a third position as the valve positions thereof. The first position may be the valve position for communicating the first port 21L and the accumulator part 42. Moreover, the second position may be the valve position for blocking the swing control part 40 and the accumulator part 42 from each other. Further, the third position may be the valve position for communicating the second port 21R and the accumulator part 42.

The selector valve 410D can be a valve for controlling a flow of the working oil from the accumulator part 42 to the swing control part 40 at the time of a release (motoring) operation of the accumulator part 42. In this embodiment, the selector valve 410D can be a 3-port 3-position selector valve, and may be formed by a solenoid valve that switches a valve position thereof according to a control signal from the controller 30. In addition, the selector valve 410D may be formed by a proportional valve that uses the pilot pressure. More particularly, the selector valve 410D can have a first position, a second position, and a third position as the valve positions thereof. The first position may be the valve position for communicating the accumulator part 42 and the first port 21L. Moreover, the second position may be the valve position for blocking the accumulator part 42 and the swing control part 40 from each other. Further, the third position may be the valve position for communicating the accumulator part 42 and the second port 21R.

The check valve 411R can be a valve for preventing a flow of the working oil from the accumulator part 42 to the swing control part 40. In addition, the check valve 411D can be a valve for preventing a flow of the working oil from the swing control part 40 to the accumulator part 42.

In the following description, a combination of the selector valve 410R and the check valve 411R may be referred to as a first accumulator (recovery) circuit, and a combination of the selector valve 410D and the check valve 411D may be referred to as a first release (motoring) circuit.

The accumulator part 42 can be a hydraulic circuit element for accumulating the excess working oil within the hydraulic circuit, and releasing the accumulated working oil according to the needs. For example, the accumulator part 42 may accumulate the working oil on a braking side (ejection side) of the swing hydraulic motor 21 during a swing deceleration, and release the working oil on a driving side (suction side) of the swing hydraulic motor 21 during a swing acceleration. In this embodiment, the accumulator part 42 may mainly include a first accumulator 420A, a second accumulator 420B, a first on-off valve 421A, and a second on-off valve 421B.

The first accumulator 420A and the second accumulator 420B can be devices for accumulating the excess working oil within the hydraulic circuit, and releasing the accumulated working oil according to the needs. In this embodiment, the first accumulator 420A and the second accumulator 420B can be bladder type accumulators that utilize nitrogen gas, and accumulate or release the working oil utilizing compressibility of the nitrogen gas and incompressibility of the working oil. Further, in this embodiment, a capacity of the first accumulator 420A may be equal to a capacity of the second accumulator 420B.

The first on-off valve 421A can be a valve that opens and closes according to a control signal from the controller 30, and in this embodiment, may control the accumulation and release of the first accumulator 420A. Similarly, the second on-off valve 421B can be a valve that opens and closes according to a control signal from the controller 30, and in this embodiment, may control the accumulation and release of the second accumulator 420B.

During the swing deceleration, the controller 30 may control the first on-off valve 421A to a state capable of opening in a case in which the pressure on the braking side (ejection side) of the swing hydraulic motor 21 is higher than a pressure of the first accumulator 420A, and control the first on-off valve 421A to close in a case in which the pressure on the braking side (ejection side) of the swing hydraulic motor 21 is lower than the pressure of the first accumulator 420A. Hence, the controller 30 can prevent the working oil of the first accumulator 420A from flowing to the braking side (ejection side) of the swing hydraulic motor 21 during the swing deceleration. In addition, during the swing acceleration, the controller 30 may control the first on-off valve 421A to the state capable of opening in the case in which the pressure of the first accumulator 420A is higher than the pressure on the driving side (suction side) of the swing hydraulic motor 21, and control the first on-off valve 421A to close in the case in which the pressure of the first accumulator 420A is lower than the pressure on the driving side (suction side) of the swing hydraulic motor 21. For this reason, the controller 30 can prevent the working oil on the driving side (suction side) of the swing hydraulic motor 21 from flowing to the first accumulator 420A during the swing acceleration. The second on-off valve 421B may be controlled to open and close in relation to the second accumulator 420B, in a manner similar to the above.

Next, a description will be given of the changes in an operation lever pressure Pi, a swing motor pressure Ps, and an accumulator pressure Pa with the lapse of time, at the times of the accumulation (recovery) operation and the release (motoring) operation, by referring to FIG. 4. In this embodiment, the change in the operation lever pressure Pi at an upper part of FIG. 4 indicates the pilot pressure that changes according to the operation of a swing operation lever. In addition, the change in the swing motor pressure Ps at a middle part of FIG. 4 indicates a change in a detected value of each of the pressure sensors S2L and S2R. Further, the change in the accumulator pressure Pa at a lower part of FIG. 4 indicates a change in the pressure of the first accumulator 420A and the pressure of the second accumulator 420B, derived from detected values of the pressure sensors S3.

At a time t1, when the swing operation lever is tilted from a neutral position, the operation lever pressure Pi increases to a pressure according to a tilted amount of the lever. In addition, at a time t2, when the swing operation lever is returned to the neutral position, the operation lever pressure Pi decreases to the pressure before the swing operation. A swing velocity has a tendency of becoming higher as the operation lever pressure Pi becomes higher.

Moreover, at the time t1, when the swing operation lever is tilted and a valve of the control valve 17 corresponding to the swing hydraulic motor 21 is driven, the pressure on the driving side of the swing hydraulic motor 21 increases. This is because the working oil ejected from the main pump 14 flows to the driving side of the swing hydraulic motor 21.

Further, at a time t2, when the swing operation lever is returned and the valve of the control valve 17, corresponding to the swing hydraulic motor 21, is returned to the state before the swing operation, the pressure on the driving side of the swing hydraulic motor 21 decreases to the pressure before the swing operation, while the pressure on the braking side of the swing hydraulic motor 21 increases. This is because the flow of the working oil from the braking side of the swing hydraulic motor 21 to the tank is blocked. The increase in the pressure on the braking side of the swing hydraulic motor 21 generates a braking torque. In the following description, a time interval in which the pressure on the driving side increases will be referred to as "a swing acceleration interval", and a time interval in which the pressure on the braking side increases will be referred to as "a swing deceleration interval".

In this embodiment, a solid line in the middle part of FIG. 4 indicates the change in the pressure on the driving side (for example, on the side of the first port 21L) detected by the pressure sensor S2L. In addition, a dotted line in the middle part of FIG. 4 indicates the change in the pressure on the braking side (for example, on the side of the second port 21R) detected by the pressure sensor S2R.

In addition, the solid line in the middle part of FIG. 4 indicates the pressure on the driving side that changes up to a relief pressure Ps-max. This indicates that the working oil from the swing hydraulic motor 21 is supplied from the main pump 14 with a pump discharge pressure higher than or equal to the relief pressure, and that the swing hydraulic motor 21 is rotated while ejecting a part of the working oil to the tank via the relief valve 400L.

On the other hand, the dotted line in the middle part of FIG. 4 indicates the pressure on the braking side that changes up to the relief pressure Ps-max. This indicates that, when braking the swing hydraulic motor 21, the working oil is accumulated in the accumulator part 42 while a part of the working oil is ejected to the tank via the relief valve 400R.

At the time t2, when the pressure on the braking side of the swing hydraulic motor 21 increases, the accumulator part 42 can store the working oil on the braking side of the swing hydraulic motor 21. In other words, the accumulator part 42 can recover hydraulic energy. More particularly, the controller 30 can output a control signal with respect to the selector valve 410R to control the selector valve 410R to the third position thereof, in order to communicate the second port 21R and the accumulator part 42. Further, the controller 30 can output a control signal with respect to the first on-off valve 421A to open the first on-off valve 421A, so that the working oil on the braking side (side of the second port 21R) of the swing hydraulic motor 21 flows into the first accumulator 420A. In this state, the second on-off valve 421B is closed, so that the working oil will not flow from the second accumulator 420B and the working oil does not flow into the second accumulator 420B.

In this embodiment, a one-dot chain line in the lower part of FIG. 4 indicates the change in the pressure of the first accumulator 420A detected by the pressure sensor S3. In addition, a two-dot chain line in the lower part of FIG. 4 indicates the change in the pressure of the second accumulator 420B detected by the pressure sensor S3.

As illustrated in the lower part of FIG. 4, at the time t2, the pressure of the first accumulator 420A starts to increase, and reaches a maximum release pressure Pa-max at a time t3.

The "maximum release pressure" may refer to a maximum pressure releasable from the accumulator, and can be a pressure that is determined by a maximum pressure of the accumulator at the time of the accumulation (recovery) operation during the swing deceleration interval. In this embodiment, the maximum release pressure Pa-max of the first accumulator 420A can be adjusted to a value equal to the relieve pressure Ps-max by controlling the open and closed states of the first on-off valve. The maximum release pressure Pa-max of the second accumulator 420B can be adjusted in a similar manner.

Thereafter, at the time t3, when the pressure of the first accumulator 420A reaches the maximum release pressure Pa-max, the accumulator part 42 ends the accumulation by the first accumulator 420A, and starts the accumulation by the second accumulator 420B. More particularly, the controller 30 can output a control signal with respect to the first on-off valve 421A to close the first on-off valve 421A, in order to interrupt the flow of the working oil on the braking side (side of the second port 21R) of the swing hydraulic motor 21 to the first accumulator 420A. On the other hand, the controller 30 can output a control signal with respect to the second on-off valve 421B to open the second on-off valve 421B, so that the working oil on the braking side (side of the second port 21R) of the swing hydraulic motor 21 flows into the second accumulator 420B.

For this reason, as illustrated in the lower part of FIG. 4, at the time t3, the pressure of the second accumulator 420B starts to increase, and the pressure continues to increase until a time t4.

At the time t4, when the pressure on the braking side (side of the second port 21R) of the swing hydraulic motor 21 starts to decrease, the accumulator part 42 ends the accumulation by the second accumulator 420B. More particularly, the controller 30 can output a control signal with respect to the second on-off valve 421B to close the second on-off valve 421B, in order to prevent the flow of the working oil from the second accumulator 420B.

Accordingly, the accumulator part 42 having the two accumulators can more quickly increase the pressure of the accumulator at the time of the accumulation (recovery) operation during the swing deceleration interval, when compared to a case in which a single accumulator having twice the capacity of each of the two accumulators is provided.

In this respect, a dotted line in the lower part of FIG. 4 indicates a change in the pressure of a large-capacity accumulator, other than and having a capacity larger than the first accumulator 420A and the second accumulator 420B, for a case in which this large-capacity accumulator is used.

As illustrated in the lower part of FIG. 4, in the configuration provided with the large-capacity accumulator, the accumulator pressure Pa cannot be increased to the maximum release pressure Pa-max before the swing of the swing hydraulic motor 21 stops. On the other hand, in the configuration of this embodiment provided with the two accumulators having the relatively small capacity, the pressure of at least one of the two accumulators can be increased to the maximum release pressure Pa-max before the swing of the swing hydraulic motor 21 stops.

As a result, according to the configuration of this embodiment, it is possible to flexibly cope even with respect to a case in which a high release pressure is required at the time of the release (motoring) operation during the swing acceleration interval.

Next, a description will be given of the operation lever pressure Pi, the swing motor pressure Ps, and the accumulator pressure Pa with the lapse of time, at the time of the release (motoring) operation during the swing acceleration interval, by referring to FIG. 5. FIG. 5 illustrates the change for a case in which the swing hydraulic motor 21 is rotated using the working oil from the accumulator part 42, and differs in this respect from FIG. 4 illustrating the change for the case in which the swing hydraulic motor 21 is rotated using the working oil from the main pump 14. In addition, in this embodiment, the change in the operation lever pressure Pi in an upper part of FIG. 5 indicates the change in the pilot pressure that varies according to the operation of the swing operation lever. Moreover, the change in the swing motor pressure Ps in a middle part of FIG. 5 indicates only the change in the pressure (detected value of the pressure sensor S2L) on the driving side of the swing hydraulic motor 21, and the illustration of the change in the pressure (detected value of the pressure sensor S2R) on the braking side of the swing hydraulic motor 21 is omitted. Further, the change in the accumulator pressure Pa in a lower part of FIG. 5 indicates a change (one-dot chain line) in the pressure of the first accumulator 420A and a change (two-dot chain line) in the pressure of the second accumulator 420B.

At a time t11, when the swing operation lever is tilted from the neutral position, the operation lever pressure Pi increases to a pressure according to the tilted amount of the lever. In addition, at a time t13, when the swing operation lever is returned to the neutral position, the operation lever pressure Pi decreases to the pressure before the swing operation.

Moreover, at the time t11, when the swing operation lever is tilted, the swing motor pressure Ps increases because the swing hydraulic motor 21 is rotated. In this embodiment, the working oil is accumulated in the accumulator part 42 at the maximum release pressure Pa-max. For this reason, unlike the case of FIG. 4, the swing control part 40 can rotate the swing hydraulic motor 21 by utilizing the working oil accumulated in the accumulator part 42. More particularly, the controller 30 can output a control signal with respect to the check valve 410D to control the check valve 410D to the first position thereof, in order to communicate the first port 21L and the accumulator part 42. Further, the controller 30 can output a control signal with respect to the first on-off valve 421A to open the first on-off valve 421A, in order to flow the working oil of the first accumulator 420A to the driving side (side of the first port 21L) of the swing hydraulic motor 21.

The swing control part 40 can rotate the swing hydraulic motor 21 by the combined use of the working oil ejected from the main pump 14 and the working oil accumulated in the accumulator part 42. In other words, the accumulator part 42 can assist the rotation of the swing hydraulic motor 21 that is rotated by the main pump 14. However, the swing control part 40 may rotate the swing hydraulic motor 21 using only the working oil accumulated in the accumulator part 42. In other words, the accumulator part 42 may, solely by itself, rotate the swing hydraulic motor 21.

The pressure on the driving side of the swing hydraulic motor 21 increases to a vicinity of the relief pressure Ps-max due to the working oil flowing from the first accumulator part 420A, and thereafter decreases with the decrease of the pressure of the first accumulator part 420A. The pressure on the driving side of the swing hydraulic motor 21 will not exceed the relief pressure Ps-max. This is because the maximum release pressure Pa-max of the first accumulator 420A is suppressed to the relief pressure Ps-max or lower.

Thereafter, at a time t12, when the pressure of the first accumulator 420A decreases to a predetermined release pressure Pa-t, the accumulator part 42 discontinues the supply of the working oil from the first accumulator 420A and starts to the supply the working oil from the second accumulator 420B. More particularly, the controller 30 can output a control signal with respect to the first on-off valve 421A to close the first on-off valve 421A, and on the other hand, can output a control signal with respect to the second on-off valve 421B to open the second on-off valve 421B.

As a result, the pressure on the driving side of the swing hydraulic motor 21 may again increase to a vicinity of the relief pressure Ps-max due to the working oil flowing from the second accumulator 420B, and thereafter decrease with the decrease of the pressure of the second accumulator part 420B. The pressure on the driving side of the swing hydraulic motor 21 will not exceed the relief pressure Ps-max. This is because the maximum release pressure Pa-max of the second accumulator 420B is suppressed to the relief pressure Ps-max or lower.

Thereafter, at a time t13, when the swing operation lever is returned to the neutral position, the accumulator part 42 discontinues the supply of the working oil from the second accumulator 420B to the driving side (side of the first port 21L) of the swing hydraulic motor 21, and the release (motoring) operation ends. More particularly, the controller 30 can output a control signal with respect to the second on-off valve 421B to close the second on-off valve 421B. In addition, the controller 30 can output a control signal with respect to the check valve 410R to control the check valve 410D to the second position thereof, in order to block the communication between the swing control part 40 and the accumulator part 42.

As a result, the pressure on the driving side of the swing hydraulic motor 21 decreases to the pressure before the swing operation. Thereafter, although omitted in FIG. 5, the accumulation (recovery) operation starts as the pressure on the driving side of the swing hydraulic motor 21 increases.

According to the configuration described above, the accumulator part 42 that includes the plurality of accumulators having the relatively small capacity can more quickly increase the pressure of at least one of the accumulators at the time of the accumulation (recovery) operation during the swing deceleration interval, when compared to the configuration in which the single accumulator having the relatively large capacity is provided, even though a total amount of storable working oil is the same for the two accumulator parts. Hence, it is possible to flexibly cope with the release pressure that is required at the time of the release (motoring) operation during the swing acceleration interval. As a result, the configuration according to this embodiment can increase opportunities at which the release (motoring) operation is executable, and further promote the energy saving by the accumulators.

In addition, the accumulators having the relatively small capacity can be advantageous in that the size of each accumulator is small, to facilitate implementation of the accumulators in the shovel.

Another Embodiment

Figure 6:
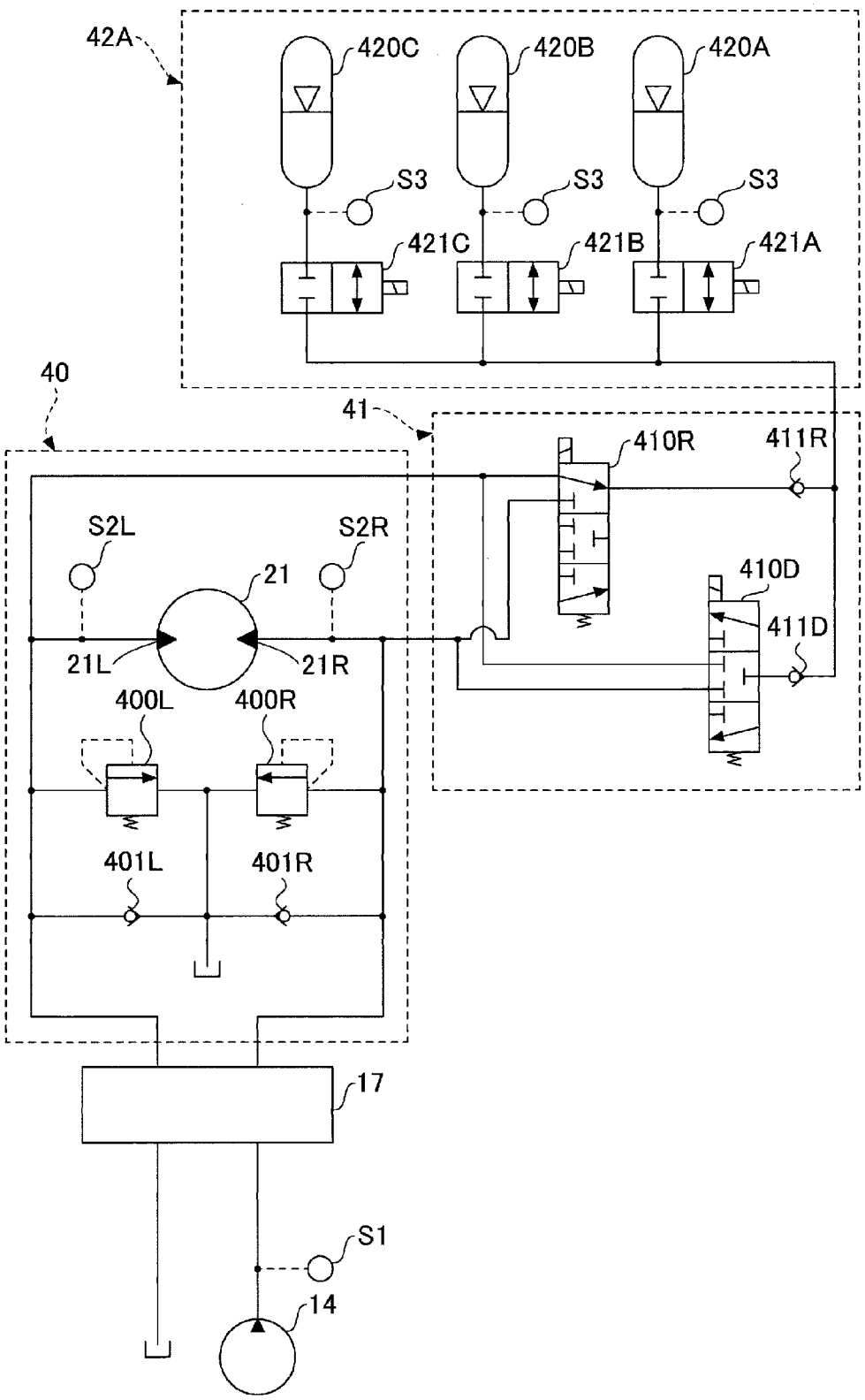
FIG. 6 is a diagram illustrating an example of the main configuration of the hydraulic circuit according to another embodiment.
Figure 7:
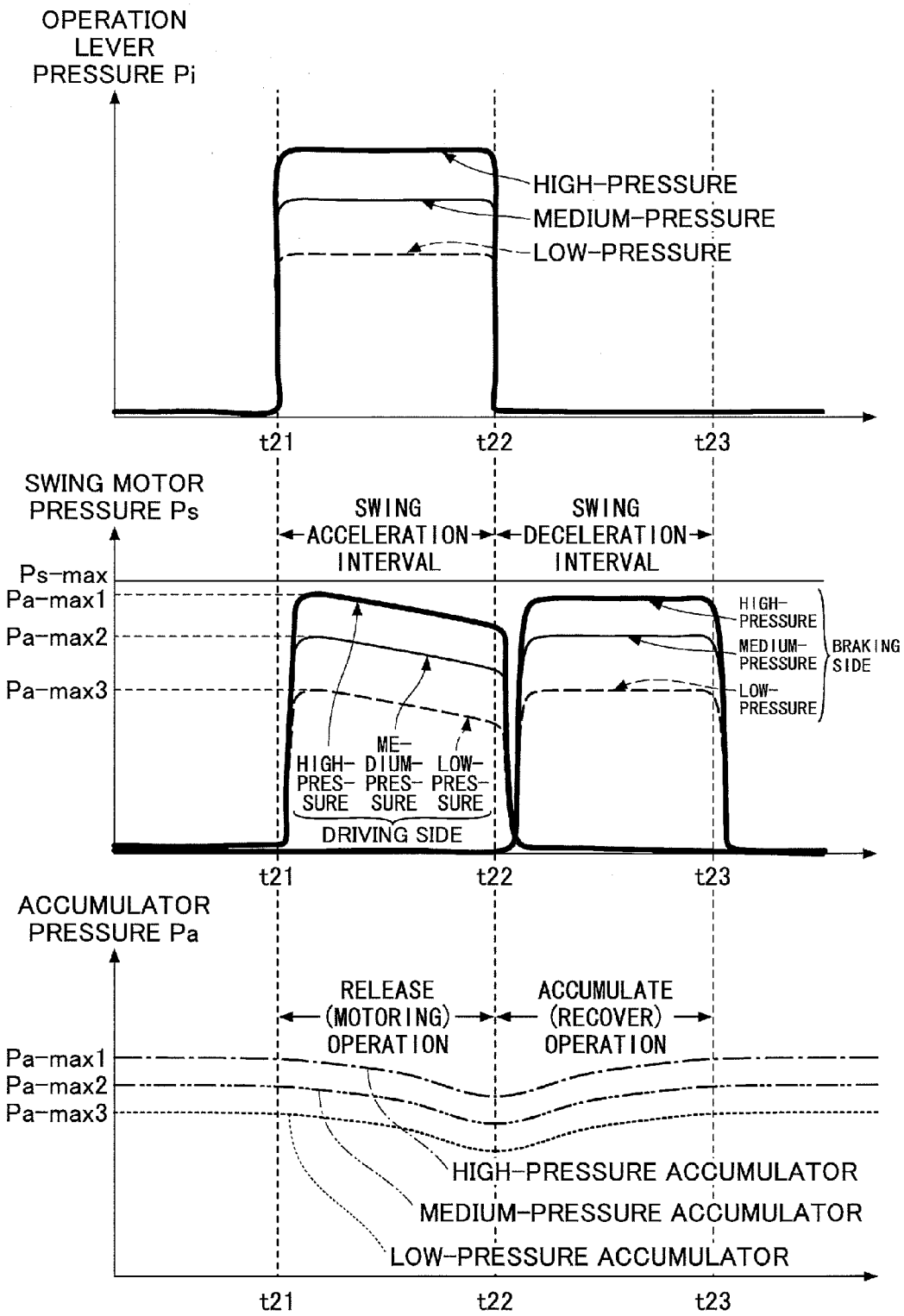
FIG. 7 is a diagram illustrating the change in the various pressures with the lapse of time, at the times of the accumulation and release of the accumulator according to the other embodiment.

Next, a description will be given of the accumulation and release of the accumulator provided in the hydraulic shovel according to another embodiment of the present invention, by referring to FIGS. 6 and 7. FIG. 6 is a diagram illustrating an example of the main configuration of the hydraulic circuit according to this other embodiment, provided on the hydraulic shovel of FIG. 1. FIG. 7 is a diagram illustrating the change in the various pressures with the lapse of time, at the times of the accumulation and release of the accumulator according to this other embodiment.

The hydraulic circuit of FIG. 6 differs from the hydraulic circuit of FIG. 3 including the accumulator part 42 having the two accumulators having the same maximum release pressure, in that an accumulator part 42A includes three accumulators having mutually different maximum release pressures. However, other parts of the hydraulic circuit of FIG. 6 may be the same as those corresponding parts of the hydraulic circuit of FIG. 3. For this reason, a description of the same parts will be omitted, and a detailed description will be given on the differences.

As illustrated in FIG. 6, the accumulator part 42A may mainly include a high-pressure (high-speed) accumulator 420A, a medium-pressure (medium-speed) accumulator 420B, a low-pressure (low-speed) accumulator 420C, a first on-off valve 421A, a second on-off valve 421B, and a third on-off valve 421C.

The first accumulator 420A, the second accumulator 420B, and the third accumulator 420C can be devices that accumulate the excess working oil within the hydraulic circuit, and release the accumulated working oil according to the needs. In this embodiment, each of the accumulators may have an arbitrary capacity, and the capacities of the accumulators may all be the same or, may be different.

The first on-off valve 421A, the second on-off valve 421B, and the third on-off valve 421C can be valves that open and close according to control signals from the controller 30, and in this embodiment, control the accumulation and release of the first accumulator 420A, the second accumulator 420B, and the third accumulator 420C, respectively.

Next, a description will be given of the changes in an operation lever pressure Pi, a swing motor pressure Ps, and an accumulator pressure Pa with the lapse of time, at the times of the release (motoring) operation and the accumulation (recovery) operation, by referring to FIG. 7. In this embodiment, the change in the operation lever pressure Pi at an upper part of FIG. 7 indicates the pilot pressure that changes according to the operation of the swing operation lever. In addition, the change in the swing motor pressure Ps at a middle part of FIG. 7 indicates the change (swing acceleration interval) in the pressure (detected value of the pressure sensor S2L) on the driving side of the swing hydraulic motor 21 and the change in the (swing deceleration interval) in the pressure (detected value of the pressure sensor S2R) on the braking side of the swing hydraulic motor 21. Further, the change in the accumulator pressure Pa at a lower part of FIG. 7 indicates the change (one-dot chain line) in the pressure of the high-pressure accumulator 420A, the change (two-dot chain line) in the pressure of the medium-pressure accumulator 420B, and the change (dotted line) in the pressure of the low-pressure accumulator 420C, derived from the detected values of the pressure sensors S3. In the upper part of FIG. 7 and the lower part of FIG. 7, the change indicated by a bold solid line indicates a case of a high-speed swing, the change indicated by a thin solid line indicates a case of a medium-speed swing, and the change indicated by a dotted line indicates a case of a low-speed swing.

At a time t21, when the swing operation lever is tilted from a neutral position, the operation lever pressure Pi increases to the pressure according to the tilted amount of the lever. In this embodiment, the operation lever pressure Pi increases to one of the pressure according to the tilted amount of the lever in the case of the high-speed swing, the pressure according to the tilted amount of the lever in the case of the medium-speed swing, and the pressure according to the tilted amount of the lever in the case of the low-speed swing. In addition, at a time t22, when the swing operation lever is returned to the neutral position, the operation lever pressure Pi decreases to the pressure before the swing operation.

Moreover, at the time t21, when the swing operation lever is tilted, the swing motor pressure Ps increases in order to rotate the swing hydraulic motor 21.

In this embodiment, the working oil having a maximum release pressure Pa-max1 is accumulated in the high-pressure accumulator 420A, the working oil having a maximum release pressure Pa-max2 is accumulated in the medium-pressure accumulator 420B, and the working oil having a maximum release pressure Pa-max3 is accumulated in the low-pressure accumulator 420C. The maximum release pressure Pa-max1 is higher than the maximum release pressure Pa-max2, and the maximum release pressure Pa-max2 is higher than the maximum release pressure Pa-max3.

For this reason, the swing control part 40 can rotate the swing hydraulic motor 21 by utilizing the working oil accumulated in the accumulator part 42A.

More particularly, the controller 30 can output a control signal with respect to the selector valve 410D to control the selector valve 410D to the first position thereof, in order to communicate the first port 21L and the accumulator part 42A.

In the case of the high-speed swing, when the pressure on the driving side of the swing hydraulic motor 21 becomes a high pressure (a first predetermined pressure or higher), the controller 30 can output a control signal with respect to the first on-off valve 421A to open the first on-off valve 421A, in order to flow the working oil of the high-pressure accumulator 420A to the driving side (side of the first port 21L) of the swing hydraulic motor 21. Or, in the case of the medium-speed swing, when the pressure on the driving side of the swing hydraulic motor 21 becomes a medium pressure (a second predetermined pressure or higher and lower than the first predetermined pressure), the controller 30 can output a control signal with respect to the second on-off valve 421B to open the second on-off valve 421B, in order to flow the working oil of the medium-pressure accumulator 420B to the driving side (side of the first port 21L) of the swing hydraulic motor 21. Or, in the case of the low-speed swing, when the pressure on the driving side of the swing hydraulic motor 21 becomes a low pressure (lower than the second predetermined pressure), the controller 30 can output a control signal with respect to the third on-off valve 421C to open the third on-off valve 421C, in order to flow the working oil of the low-pressure accumulator 420C to the driving side (side of the first port 21L) of the swing hydraulic motor 21. The state (which one of high-speed swing, medium-speed swing, and low-speed swing) of the swing velocity of the swing hydraulic motor 21 can be judged based on the discharge pressure of the main pump 14 detected by the pressure sensor S1, the pressure on the side of the first port 21L of the swing hydraulic motor 21 detected by the pressure sensor 21L, the pressure on the side of the second port 21R of the swing hydraulic motor 21 detected by the pressure sensor S2R, the operated amount of the swing operation lever, or the like. In addition, instead of judging the state of the swing velocity of the swing hydraulic motor 21, the controller 30 may judge a state of the load on the swing hydraulic motor 21. Moreover, the controller 30 may judge the state of the swing velocity or the state of the load, based on other physical quantities, such as the boom cylinder pressure, the arm cylinder pressure, or the like.

The swing control part 40 can rotate the swing hydraulic motor 21 by the combined use of the working oil ejected from the main pump 14 and the working oil accumulated in the accumulator part 42A. However, the swing control part 40 may rotate the swing hydraulic motor 21 using only the working oil accumulated in the accumulator part 42A.

As a result, at a time t21, the accumulator pressure Pa in the lower part of FIG. 7 starts to decrease, and continues to decrease until the swing operation lever is returned at a time t22, or until a predetermined release pressure is reached.

At the time t22, when the swing operation lever is returned, the pressure on the braking side of the swing hydraulic motor 21 decreases to the pressure before the swing operation, while on the other hand, the pressure on the braking side of the swing hydraulic motor 21 increases. This is because the flow of the working oil from the main pump 14 to the driving side of the swing hydraulic motor 21 is blocked, and the flow of the working oil from the braking side of the swing hydraulic motor 21 to the tank is blocked. The increase in the pressure on the braking side generates a braking torque.

At the time t22, when the pressure on the braking side of the swing hydraulic motor 21 increases, the accumulator part 42A can store the working oil on the braking side of the swing hydraulic motor 21. In other words, the accumulator part 42A can recover the hydraulic energy. More particularly, the controller 30 can output a control signal with respect to the selector valve 410R to control the selector valve 410R to the third position thereof, in order to communicate the swing control part 40 (second port 21R) and the accumulator part 42A.

In addition, when making a high-speed stop of the swing, such as a case in which the pressure on the braking side of the swing hydraulic motor 21 becomes the high pressure, for example, the controller 30 can output a control signal with respect to the first on-off valve 421A to open the first on-off valve 421A, so that the working oil on the braking side (side of the second port 21R) of the swing hydraulic motor 21 flows into the high-pressure accumulator 420A. Or, when making a medium-speed stop of the swing, such as a case in which the pressure on the braking side of the swing hydraulic motor 21 becomes the medium pressure, for example, the controller 30 can output a control signal with respect to the second on-off valve 421B to open the second on-off valve 421B, so that the working oil on the braking side (side of the second port 21R) of the swing hydraulic motor 21 flows into the medium-pressure accumulator 420B. Or, when making a low-speed stop of the swing, such as a case in which the pressure on the braking side of the swing hydraulic motor 21 becomes the low pressure, for example, the controller 30 can output a control signal with respect to the third on-off valve 421C to open the third on-off valve 421C, so that the working oil on the braking side (side of the second port 21R) of the swing hydraulic motor 21 flows into the low-pressure accumulator 420C.

As a result, at the time t22, the accumulator pressure Pa in the lower part of FIG. 7 starts to increase, and continues to increase until the pressure on the braking side of the swing hydraulic motor 21 returns to the state before the swing operation at a time t23.

According to the configuration described above, the hydraulic circuit according to this other embodiment enables selection of the accumulator at an accumulating destination that is to accumulate the working oil from the plurality of accumulators having the mutually different maximum release pressures, according to a desired swing motor pressure Ps at the time of the accumulation (recovery) operation. As a result, the accumulation (recovery) operation can be performed even when the desired swing motor pressure Ps is low.

In addition, the hydraulic circuit according to this other embodiment enables selection of the accumulator at a supply source that is to supply the working oil from the plurality of accumulators having the mutually different maximum release pressures, according to the required release pressure. As a result, the accumulator having the low release pressure can be utilized more efficiently.

Further, the high-pressure accumulator 420A, the medium-pressure accumulator 420B, and the low-pressure accumulator 420C may be set with a release pressure range that is determined by the maximum release pressure and a minimum release pressure. In this case, at the time of the accumulation (recovery) operation, the working oil on the braking side of the swing hydraulic motor 21 can be accumulated in the accumulator having the release pressure range suited for the pressure of the working oil on the braking side. In the embodiment described above and in this other embodiment, the control valve 17 is illustrated as a means for blocking the working oil from flowing from the main pump 14 to the driving side of the swing hydraulic motor 21 during the releasing of the accumulator pressure. However, the flow of the working oil may be blocked by use of a selector valve, instead of using the control valve 17.

Further Embodiment

Figure 8:
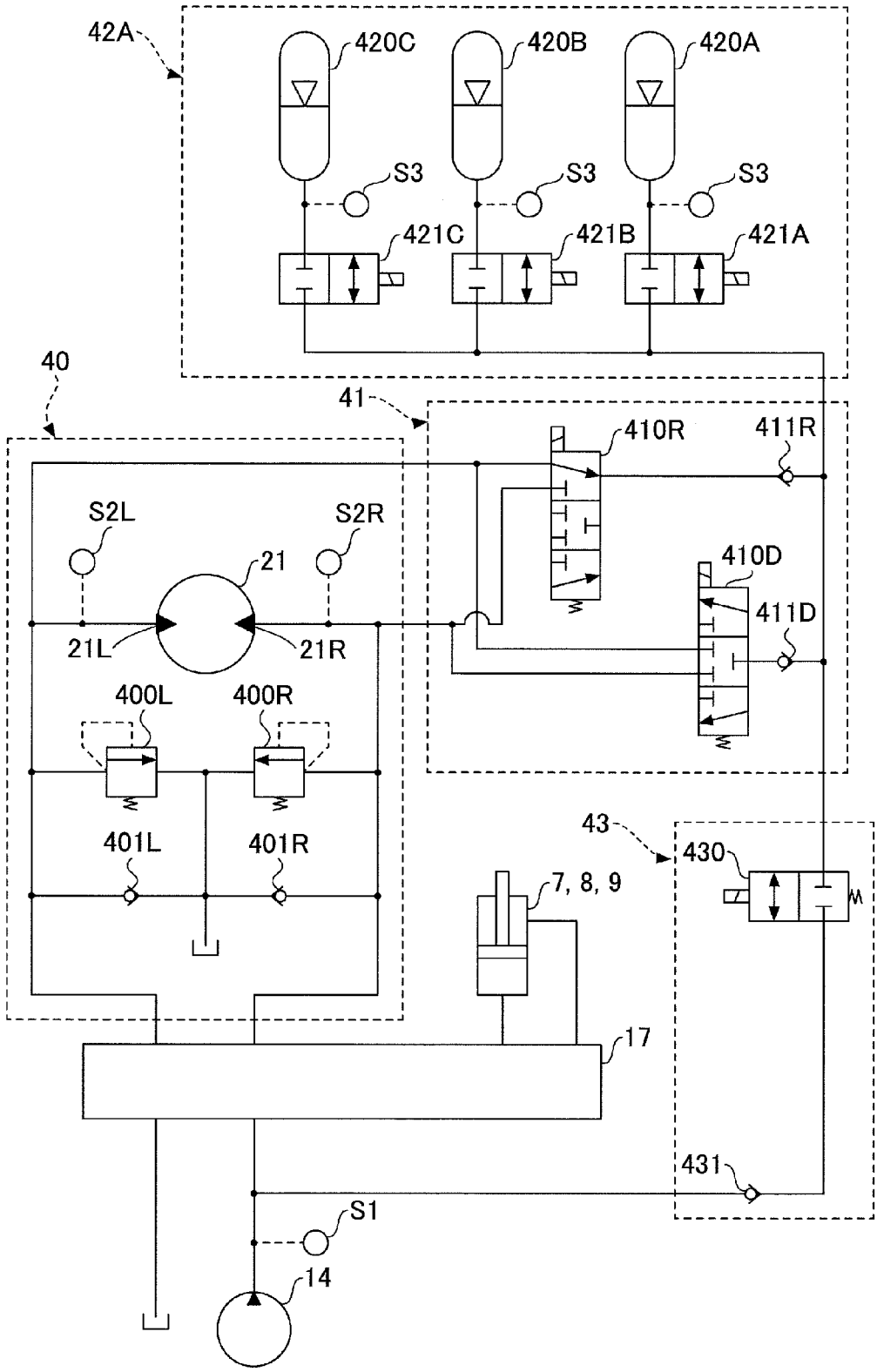
FIG. 8 is a diagram illustrating an example of the main configuration of the hydraulic circuit according to a further embodiment.
Figure 9:
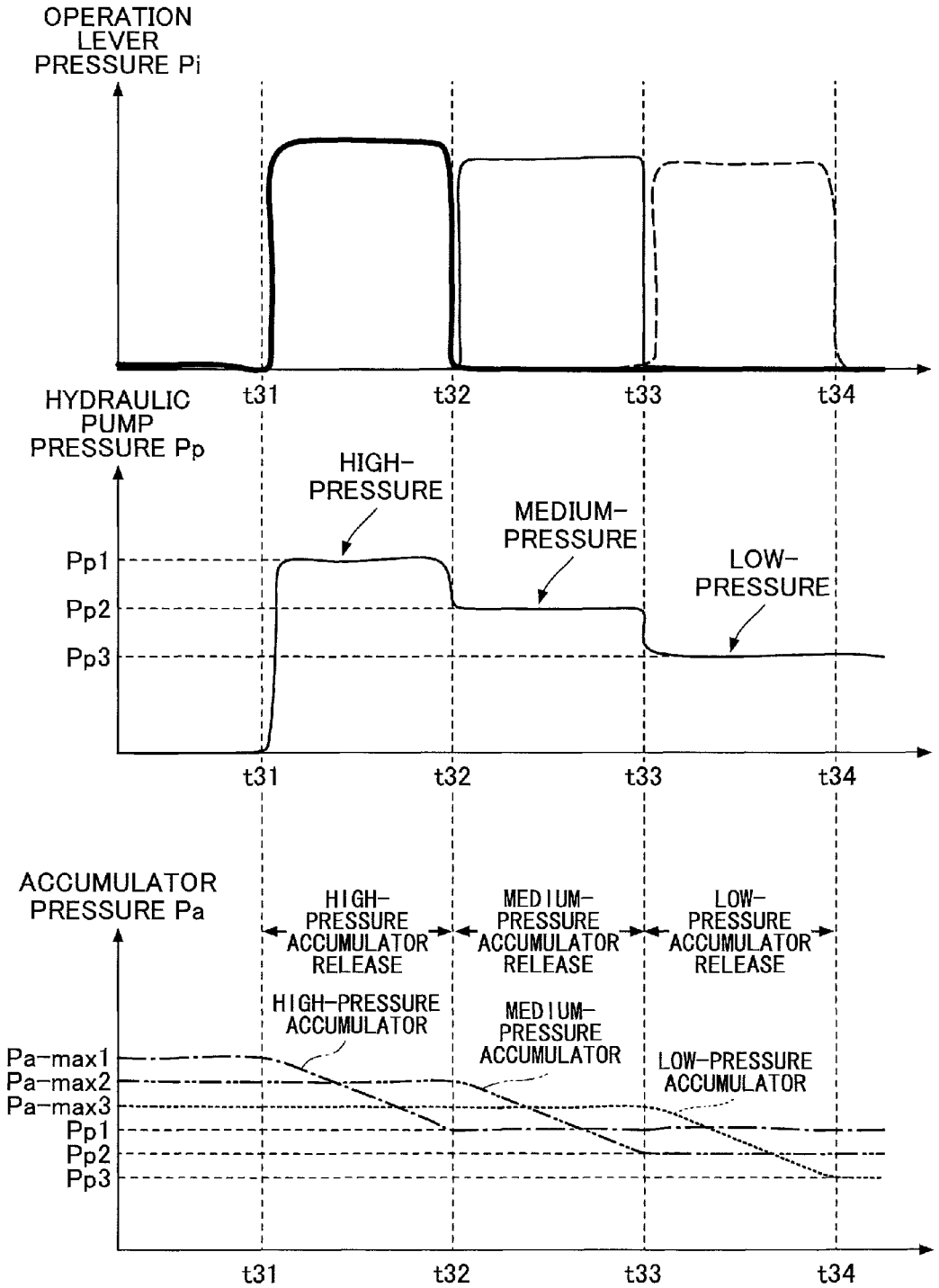
FIG. 9 is a diagram illustrating the various pressures at the time of the release of the accumulator according to the further embodiment.

Next, a description will be given of the release of the accumulator provided in the hydraulic shovel according to a further embodiment of the present invention, by referring to FIGS. 8 and 9. FIG. 8 is a diagram illustrating an example of the main configuration of the hydraulic circuit according to the this further embodiment, provided on the hydraulic shovel of FIG. 1. FIG. 9 is a diagram illustrating the various pressures at the time of the release of the accumulator according to this further embodiment.

The hydraulic circuit of FIG. 8 differs from the hydraulic circuit of FIG. 6, in that a second release (motoring) circuit 43 connects the accumulator part 42A and an upstream side of the control valve 17. However, other parts of the hydraulic circuit of FIG. 8 may be the same as those corresponding parts of the hydraulic circuit of FIG. 6. For this reason, a description of the same parts will be omitted, and a detailed description will be given on the differences.

The second release (motoring) circuit 43 can be a hydraulic circuit constituent element for connecting the accumulator part 42A and the upstream side of the control valve 17. In this embodiment, the second release (motoring) circuit 43 may mainly include a selector valve 430 and a check valve 431.

The selector valve 430 can be a valve for controlling the flow of the working oil from the accumulator part 42A to the control valve 17, at the time of the release (motoring) operation of the accumulator part 42A.

In this embodiment, the selector valve 430 can be a 2-port 2-position selector valve, and may be formed by a solenoid valve that switches a valve position thereof according to a control signal from the controller 30. In addition, the selector valve 430 may be formed by a proportional valve that uses the pilot pressure. More particularly, the selector valve 430 can have a first position and a second position as the valve positions thereof. The first position may be the valve position for communicating the accumulator part 42A and the control valve 17. Moreover, the second position may be the valve position for blocking the accumulator part 42A and the control valve 17 from each other.

The check valve 431 can be a valve for preventing the working oil from flowing from the main pump 14 to the accumulator part 42A.

At the time of the release (motoring) operation, the controller 30 can close the first release (motoring) circuit and open the second release (motoring) circuit, in order to supply the working oil from the accumulator part 42A to the control valve 17. Or, at the time of the release (motoring) operation, the controller 30 can open the first release (motoring) circuit and close the second release (motoring) circuit, in order to supply the working oil from the accumulator part 42A to the swing hydraulic motor 21. At the time of the release (motoring) operation, the controller 30 may open both the first release (motoring) circuit and the second release (motoring) circuit, in order to supply the working oil from the accumulator part 42A to both the swing hydraulic motor 21 and the control valve 17.

Next, a description will be given of the changes in an operation lever pressure Pi, a hydraulic pump pressure Pp, and an accumulator pressure Pa with the lapse of time, at the time of the release (motoring) operation, by referring to FIG. 9. In this embodiment, the change in the operation lever pressure Pi at an upper part of FIG. 9 indicates the pilot pressure that changes (bold solid line) according to the operation of the boom operation lever, the pilot pressure that changes (thin solid line) according to the operation of the arm operation lever, and the pilot pressure that changes (dotted line) according to the operation of the bucket operation lever. In addition, the change in the hydraulic pump pressure Pp at a middle part of FIG. 9 indicates the change in the pressure for driving the hydraulic actuator, that is, the change in the pressure (detected value of the pressure sensor S1) on the upstream side of the control valve 17. Further, the change in the accumulator pressure Pa at a lower part of FIG. 9 indicates the change (one-dot chain line) in the pressure of the high-pressure accumulator 420A, the change (two-dot chain line) in the pressure of the medium-pressure accumulator 420B, and the change (dotted line) in the pressure of the low-pressure accumulator 420C, derived from the detected values of the pressure sensors S3.

At a time t31, when the boom operation lever is tilted from a neutral position, the pilot pressure (bold solid line) related to the boom operation lever increases to the pressure according to the tilted amount of the lever. In addition, at a time t32, when the boom operation lever is returned to the neutral position, the pilot pressure (bold solid line) related to the boom operation lever decreases to the pressure before the boom operation.

At the time t32, when the arm operation lever is tilted from a neutral position, the pilot pressure (thin solid line) related to the arm operation lever increases to the pressure according to the tilted amount of the lever. In addition, at a time t33, when the arm operation lever is returned to the neutral position, the pilot pressure (thin solid line) related to the arm operation lever decreases to the pressure before the arm operation.

At the time t33, when the bucket operation lever is tilted from a neutral position, the pilot pressure (dotted line) related to the bucket operation lever increases to the pressure according to the tilted amount of the lever. In addition, at a time t34, when the bucket operation lever is returned to the neutral position, the pilot pressure (dotted line) related to the bucket operation lever decreases to the pressure before the bucket operation.

Further, at the time t31, when the boom operation lever is tilted, a hydraulic pump pressure Pp1 required to extend the boom cylinder 7 is created.

In this embodiment, the working oil having a maximum release pressure Pa-max1 is accumulated in the high-pressure accumulator 420A, the working oil having a maximum release pressure Pa-max2 is accumulated in the medium-pressure accumulator 420B, and the working oil having a maximum release pressure Pa-max3 is accumulated in the low-pressure accumulator 420C. The maximum release pressure Pa-max1 is higher than the maximum release pressure Pa-max2, and the maximum release pressure Pa-max2 is higher than the maximum release pressure Pa-max3.

For this reason, the boom cylinder 7 can operate the boom 4 by utilizing the working oil accumulated in the accumulator part 42A.

More particularly, the controller 30 can output a control signal with respect to the selector valve 430 to control the selector valve 430 to the first position thereof, in order to communicate the control valve 17 and the accumulator part 42A.

When the boom cylinder 7 is to perform a high-speed operation, such as a case in which the pressure on a driving side of the boom cylinder 7 becomes the high pressure (a first predetermined pressure or higher), for example, the controller 30 can output a control signal with respect to the first on-off valve 421A to open the first on-off valve 421A, so that the working oil of the high-pressure accumulator 420A flows to the driving side of the boom cylinder 7. The driving side of the boom cylinder 7 may refer to the side of one of a bottom side oil chamber and a rod side oil chamber having a volume that increases. The driving sides of the arm cylinder 8 and the bucket cylinder 9 may similarly refer to the side of the oil chamber having the volume that increases.

Or, when the boom cylinder 7 is to perform a medium-speed operation, such as a case in which the pressure on the driving side of the boom cylinder 7 becomes the medium pressure (the second predetermined pressure or higher and lower than the first predetermined pressure), for example, the controller 30 can output a control signal with respect to the second on-off valve 421B to open the second on-off valve 421B, so that the working oil of the medium-pressure accumulator 420B flows to the driving side of the boom cylinder 7. Or, when the boom cylinder 7 is to perform a low-speed operation, such as a case in which the pressure on the driving side of the boom cylinder 7 becomes the low pressure (lower than the second predetermined pressure), for example, the controller 30 can output a control signal with respect to the third on-off valve 421C to open the third on-off valve 421C, so that the working oil of the low-pressure accumulator 420C flows to the driving side of the boom cylinder 7. In this embodiment, because the driving side of the boom cylinder 7 is in the high-pressure state, the controller 30 can cause the working oil of the high-pressure accumulator 420A to flow to the driving side of the boom cylinder 7. The state (which one of high-speed operation, medium-speed operation, and low-speed operation) of the operation velocity of the boom cylinder 7 can be judged based on the discharge pressure of the main pump 14 detected by the pressure sensor S1, the pressure on the bottom side oil chamber of the boom cylinder 7 that is detected, the pressure on the rod side oil chamber of the boom cylinder 7 that is detected, the operated amount of the boom operation lever, or the like. In addition, instead of judging the state of the operation velocity of the boom cylinder 7, the controller 30 may judge a state of the load on the boom cylinder 7. Moreover, the controller 30 may judge the state of the operation velocity of the boom cylinder 7 or the state of the load thereon, based on other physical quantities, such as a boom angle (angle of the boom with respect to a horizontal plane), or the like. The arm cylinder 8 and the bucket cylinder 9 may be operated and the states thereof may be judged, in a manner similar to the above.

The hydraulic pump pressure Pp increases to the pressure Pp1 according to the tilted amount of the boom operation lever, due to the working oil flowing from the high-pressure accumulator 420A, and thereafter maintains this pressure level until the boom operation lever is returned to the neutral position at the time t32. In addition, the pressure of the high-pressure accumulator 420A starts to decrease from the time t31, and continues to decrease until the time t32.

Thereafter at the time t32, when the arm operation lever is tilted, a hydraulic pump pressure Pp2 required to extend the arm cylinder 8 is created.

In this embodiment, the working oil can be accumulated in the accumulator part 42A. For this reason, the arm cylinder 8 can operate the arm 5 by utilizing the working oil accumulated in the accumulator part 42A.

More particularly, the controller 30 can output a control signal with respect to the selector valve 430 to control the selector valve 430 to the first position thereof, in order to communicate the control valve 17 and the accumulator part 42A.

When the arm cylinder 8 is to perform a high-speed operation, such as a case in which the pressure on a driving side of the arm cylinder 8 becomes the high pressure, for example, the controller 30 can output a control signal with respect to the first on-off valve 421A to open the first on-off valve 421A, so that the working oil of the high-pressure accumulator 420A flows to the driving side of the arm cylinder 8. Or, when the arm cylinder 8 is to perform a medium-speed operation, such as a case in which the pressure on the driving side of the arm cylinder 8 becomes the medium pressure, for example, the controller 30 can output a control signal with respect to the second on-off valve 421B to open the second on-off valve 421B, so that the working oil of the medium-pressure accumulator 420B flows to the driving side of the arm cylinder 8. Or, when the arm cylinder 8 is to perform a low-speed operation, such as a case in which the pressure on the driving side of the arm cylinder 8 becomes the low pressure, for example, the controller 30 can output a control signal with respect to the third on-off valve 421C to open the third on-off valve 421C, so that the working oil of the low-pressure accumulator 420C flows to the driving side of the arm cylinder 8. In this embodiment, because the driving side of the arm cylinder 8 is in the medium-pressure state, the controller 30 can cause the working oil of the medium-pressure accumulator 420B to flow to the driving side of the arm cylinder 8.

The hydraulic pump pressure Pp reaches the pressure Pp2 according to the tilted amount of the arm operation lever, due to the working oil flowing from the medium-pressure accumulator 420B, and thereafter maintains this pressure level until the arm operation lever is returned to the neutral position at the time t33. In addition, the pressure of the medium-pressure accumulator 420B starts to decrease from the time t32, and continues to decrease until the time t33.

Thereafter at the time t33, when the bucket operation lever is tilted, a hydraulic pump pressure Pp3 required to extend the bucket cylinder 9 is created.

In this embodiment, the working oil can be accumulated in the accumulator part 42A. For this reason, the bucket cylinder 9 can operate the bucket 6 by utilizing the working oil accumulated in the accumulator part 42A.

More particularly, the controller 30 can output a control signal with respect to the selector valve 430 to control the selector valve 430 to the first position thereof, in order to communicate the control valve 17 and the accumulator part 42A.

When the bucket cylinder 9 is to perform a high-speed operation, such as a case in which the pressure on a driving side of the bucket cylinder 9 becomes the high pressure, for example, the controller 30 can output a control signal with respect to the first on-off valve 421A to open the first on-off valve 421A, so that the working oil of the high-pressure accumulator 420A flows to the driving side of the bucket cylinder 9. Or, when the bucket cylinder 9 is to perform a medium-speed operation, such as a case in which the pressure on the driving side of the bucket cylinder 9 becomes the medium pressure, for example, the controller 30 can output a control signal with respect to the second on-off valve 421B to open the second on-off valve 421B, so that the working oil of the medium-pressure accumulator 420B flows to the driving side of the bucket cylinder 9. Or, when the bucket cylinder 9 is to perform a low-speed operation, such as a case in which the pressure on the driving side of the bucket cylinder 9 becomes the low pressure, for example, the controller 30 can output a control signal with respect to the third on-off valve 421C to open the third on-off valve 421C, so that the working oil of the low-pressure accumulator 420C flows to the driving side of the bucket cylinder 9. In this embodiment, because the driving side of the bucket cylinder 9 is in the low-pressure state, the controller 30 can cause the working oil of the low-pressure accumulator 420C to flow to the driving side of the bucket cylinder 9.

The hydraulic pump pressure Pp reaches the pressure Pp3 according to the tilted amount of the bucket operation lever, due to the working oil flowing from the low-pressure accumulator 420C, and thereafter maintains this pressure level until the bucket operation lever is returned to the neutral position at the time t34. In addition, the pressure of the low-pressure accumulator 420C starts to decrease from the time t33, and continues to decrease until the time t34.

FIG. 9 illustrates a state in which the hydraulic pump pressure Pp changes in three stages, even though the pilot pressures (tilted amounts of the levers) related to the boom operation lever, the arm operation lever, and the bucket operation lever, respectively, are approximately the same. This is due to the different working oil pressures required to operate the boom 4, the arm 5, and the bucket 6 at approximately the same velocity.

According to the configuration described above, the hydraulic circuit according to this further embodiment can obtain the effect of enabling the accumulated working oil to be supplied to hydraulic actuators other than the swing hydraulic motor 21, in addition to obtaining the effects obtainable by the hydraulic circuit according to the other embodiment described above.

In addition, although the hydraulic circuit according to this further embodiment employs the accumulator part 42A that includes the plurality of accumulators having the mutually different maximum release pressures, it is possible to employ the accumulator part 42 that includes the plurality of accumulators having the same maximum release pressure, as illustrated for the first described embodiment.

Still Another Embodiment

Figure 10:
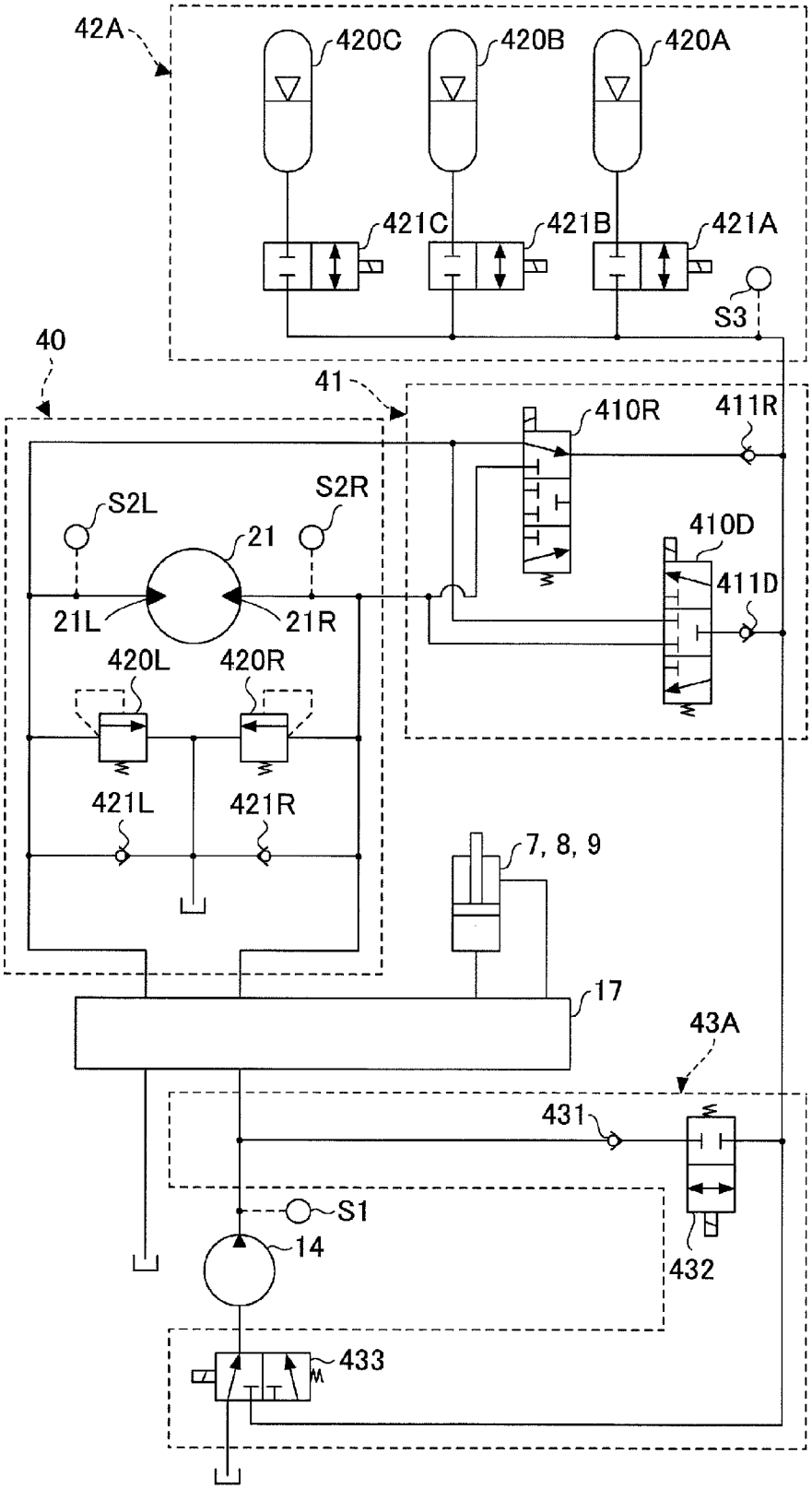
FIG. 10 is a diagram illustrating an example of the main configuration of the hydraulic circuit according to still another embodiment.

Next, a description will be given of the release of the accumulator provided in the hydraulic shovel according to still another embodiment of the present invention, by referring to FIG. 10. FIG. 10 is a diagram illustrating an example of the main configuration of the hydraulic circuit according to this still other embodiment, provided on the hydraulic shovel of FIG. 1.

The hydraulic circuit of FIG. 10 differs from the hydraulic circuit of FIG. 8 in that, in place of the second release (motoring) circuit 43 of FIG. 8, a second release (motoring) circuit 43A is provided to connect the accumulator part 42A and the upstream side (suction side) or the downstream side (ejection side) of the main pump 14. However, other parts of the hydraulic circuit of FIG. 10 may be the same as those corresponding parts of the hydraulic circuit of FIG. 8. For this reason, a description of the same parts will be omitted, and a detailed description will be given on the differences.

The second release (motoring) circuit 43A can be a hydraulic circuit constituent element for connecting the accumulator part 42A and the upstream side or the downstream side of the main pump 14. In this embodiment, the second release (motoring) circuit 43A may mainly include a downstream side selector valve 432 and an upstream side selector valve 433.

The downstream side selector valve 432 can be a valve for controlling the flow of the working oil from the accumulator part 42A, passing a junction point on the downstream side of the main pump 14, and moving towards the control valve 17, at the time of the release (motoring) operation of the accumulator part 42A.

In this embodiment, the downstream side selector valve 432 can be a 2-port 2-position selector valve, and may be formed by a solenoid valve that switches a valve position thereof according to a control signal from the controller 30. In addition, the downstream side selector valve 432 may be formed by a proportional valve that uses the pilot pressure. More particularly, the downstream side selector valve 432 can have a first position and a second position as the valve positions thereof. The first position may be the valve position for communicating the accumulator part 42A and the control valve 17 via the junction point on the downstream side of the main pump 14. Moreover, the second position may be the valve position for blocking the accumulator part 42A and the control valve 17 from each other.

The upstream side selector valve 433 can be a valve for controlling the flow of the working oil from the accumulator part 42A, passing a junction point on the upstream side of the main pump 14, and moving towards the control valve 17, at the time of the release (motoring) operation of the accumulator part 42A.

In this embodiment, the upstream side selector valve 433 can be a 2-port 2-position selector valve, and may be formed by a solenoid valve that switches a valve position thereof according to a control signal from the controller 30. In addition, the upstream side selector valve 433 may be formed by a proportional valve that uses the pilot pressure. More particularly, the upstream side selector valve 433 can have a first position and a second position as the valve positions thereof. The first position may be the valve position for communicating the accumulator part 42A and the control valve 17 via the junction point on the upstream side of the main pump 14. Moreover, the second position may be the valve position for blocking the accumulator part 42A and the control valve 17 from each other.

In a case in which the upstream side selector valve 433 is at the first position thereof, the communication between the main pump 14 and the tank can be blocked at the upstream side of the main pump 14, and the communication between the main pump 14 and the accumulator part 42A can be provided. In addition, the main pump 14 can suck in the working oil released from the accumulator part 42A and having a relatively high pressure, and can eject this working oil towards the control valve 17. As a result, a suction horsepower (torque required to eject a predetermined amount of the working oil) of the main pump 14 can be reduced compared to a case in which the working oil having a relatively low pressure is sucked in from the tank and ejected, and it is possible to promote energy saving. Further, responsiveness of the main pump 14 in response to the control of the amount of ejection can be improved.

Moreover, in a case in which the upstream side selector valve 433 is at the second position, the communication between the main pump 14 and the tank can be provided at the upstream side of the main pump 14, and the communication between the main pump 14 and the accumulator part 42A can be blocked. In this case, the main pump 14 can suck in the working oil having a relatively low pressure from the tank, and can eject this working oil towards the control valve 17.

At the time of the release (motoring) operation, the controller 30 can close the first release (motoring) circuit, and open the second release (motoring) circuit 43A, in order to supply the working oil of the accumulator part 42A to the control valve 17. Alternatively, at the time of the release (motoring) operation, the controller 30 can open the first release (motoring) circuit, and close the second release (motoring) circuit 43A, in order to supply the working oil of the accumulator part 42A to the swing hydraulic motor 21. At the time of the release (motoring) operation, the controller 30 may open both the first release (motoring) circuit and the second release (motoring) circuit 43A, and supply the working oil of the accumulator part 42A to both the swing hydraulic motor 21 and the control valve 17.

In a case in which the controller 30 opens the second release (motoring) circuit 43A, one of the downstream side selector valve 432 and the upstream side selector valve 433 can be controlled to the first position thereof, and the other can be controlled to the second position thereof.

More particularly, when the hydraulic actuator is operated, the controller 30 can control the downstream side selector valve 432 to the first position thereof and the upstream side selector valve 433 to the second position thereof, in a case in which the pressure of the accumulator part 42A is higher than the pressure on the driving side of this hydraulic actuator. Further, the controller 30 can release the working oil of the accumulator part 42A towards the control valve 17, via the junction point on the downstream side of the main pump 14.

On the other hand, when the hydraulic actuator is operated, the controller 30 can control the downstream side selector valve 432 to the second position thereof and the upstream side selector valve 433 to the first position thereof, in a case in which the pressure of the accumulator part 42A is lower than the pressure on the driving side of this hydraulic actuator. Further, the controller 30 can release the working oil of the accumulator part 42A towards the main pump 14, via the junction point on the upstream side of the main pump 14. The main pump 14 can suck in the working oil released from the accumulator part 42A and eject this working oil towards the downstream side, in place of sucking in the working oil from the tank. As a result, the suction horsepower of the main pump 14 can be reduced compared to the case in which the working oil having the relatively low pressure is sucked in from the tank and ejected.

According to the configuration described above, the hydraulic circuit according to this still other embodiment can obtain the effect of enabling the release (motoring) operation of the accumulator part 42A to be executed even in a case in which the pressure of the accumulator part 42A is lower than the pressure on the driving side of the hydraulic actuator that is to be operated, in addition to obtaining the effects obtainable by the hydraulic circuit according to each of the embodiments described above.

In addition, in the hydraulic circuit according to this still other embodiment, the second release (motoring) circuit 43A is configured to merge the working oil from the accumulator part 42A at the junction point on the upstream side or the junction point on the downstream side of the main pump 14. However, the present invention is not limited to this configuration. For example, it is possible to employ a configuration in which the second release (motoring) circuit 43A omits a conduit line including the check valve 431 and the downstream side selector valve 432, and the working oil from the accumulator part 42A is permitted to merge only at the junction point on the upstream side of the main pump 14.

Further, in a case in which the accumulation of all of the accumulators ends in the state in which the accumulation (recovery) operation is performed, or in a case in which a sufficient accumulation is already made in all of the accumulators at a point in time when the store (recovery)

operation is started, the return oil from the swing hydraulic motor 21 may be merged at the junction point on the upstream side or at the junction point on the downstream side of the main pump 14, using the second release and accumulation switching part 43A.

According to certain embodiments, it is possible to provide a shovel capable of efficiently performing accumulation and release of an accumulator.

It should be understood that the invention is not limited to the above-described embodiments, but may be modified into various forms on the basis of the spirit of the invention. Additionally, the modifications are included in the scope of the invention.

For example, in the embodiments described above, one of the plurality of accumulators is selected as the accumulating destination of the working oil at the time of the accumulation (recovery) operation, or as the supply source of the working oil at the time of the release (motoring) operation. In other words, the plurality of accumulators accumulate or release at mutually different timings. For this reason, each of the plurality of accumulators can accumulate or release the working oil without being affected by the pressures of other accumulators. However, the embodiments are not limited to this configuration. For example, two or more accumulators may be simultaneously selected as the accumulating destination or the supply source. In other words, two or more accumulators may accumulate or release at partially or completely overlapping timings.

What is claimed is:

1. A shovel comprising:

a main pump;

hydraulic actuators including a swing hydraulic motor that includes a first port and a second port;

a control valve configured to control a flow of a working oil between the main pump and the hydraulic actuators;

a plurality of accumulators connected between the swing hydraulic motor and the control valve, and configured to accumulate the working oil on a braking side of the swing hydraulic motor at a time of a swing deceleration;

a selector valve configured to switch between communicating and blocking between each of the first and second ports of the swing hydraulic motor and the plurality of accumulators;

a first pressure sensor configured to detect a pressure of the working oil on a side of the first port of the swing hydraulic motor;

a second pressure sensor configured to detect a pressure of the working oil on a side of the second port of the swing hydraulic motor; and a plurality of third pressure sensors configured to detect a pressure of the working oil in the plurality of accumulators, respectively, wherein the plurality of accumulators respectively include separate on-off valves, wherein the on-off valves open and close according to a pressure of the working oil of the swing hydraulic motor, and wherein one of the plurality of accumulators accumulates the working oil from the swing hydraulic motor at a timing different from another one of the plurality of accumulators.

2. The shovel as claimed in claim 1, wherein the plurality of accumulators include at least two accumulators having identical maximum release pressures.

3. The shovel as claimed in claim 1, wherein the plurality of accumulators include at least two accumulators having mutually different maximum release pressures.

4. The shovel as claimed in claim 1, wherein each of the plurality of accumulators is configured to release the working oil to an upstream of the main pump.

5. A shovel comprising:

a main pump;

hydraulic actuators including a swing hydraulic motor;

a control valve configured to control a flow of a working oil between the main pump and the hydraulic actuators; and a plurality of accumulators connected between the swing hydraulic motor and the control valve, and configured to accumulate the working oil on a braking side of the swing hydraulic motor at a time of a swing deceleration, wherein the plurality of accumulators respectively include separate on-off valves, and include at least two accumulators having mutually different maximum release pressures, wherein the on-off valves open and close according to a pressure of the working oil of the swing hydraulic motor, and wherein one of the plurality of accumulators accumulates the working oil from the swing hydraulic motor at a timing different from another one of the plurality of accumulators, and wherein, at a time of a swing deceleration, the working oil on a braking side of the swing hydraulic motor is accumulated in a first accumulator, in a case in which a pressure on the braking side of the swing hydraulic motor is a predetermined pressure or higher, and the working oil on the braking side of the swing hydraulic motor is accumulated in a second accumulator having a maximum release pressure lower than that of the first accumulator, in a case in which the pressure on the braking side of the swing hydraulic motor is lower than the predetermined pressure.

6. A shovel comprising:

a main pump;

hydraulic actuators including a swing hydraulic motor;

a control valve configured to control a flow of a working oil between the main pump and the hydraulic actuators; and a plurality of accumulators connected between the swing hydraulic motor and the control valve, and configured to accumulate the working oil on a braking side of the swing hydraulic motor at a time of a swing deceleration, wherein the plurality of accumulators respectively include separate on-off valves, and include at least two accumulators having mutually different maximum release pressures, wherein the on-off valves open and close according to a pressure of the working oil of the swing hydraulic motor, and wherein one of the plurality of accumulators accumulates the working oil from the swing hydraulic motor at a timing different from another one of the plurality of accumulators, and wherein, at a time of a swing acceleration, the working oil is released from a first accumulator to a driving side of the swing hydraulic motor, in a case in which a pressure on the driving side of the swing hydraulic motor is a predetermined pressure or higher, and the working oil is released from a second accumulator having a maximum release pressure lower than that of the first accumulator to the driving side of the swing hydraulic motor, in a case in which the pressure on the driving side of the swing hydraulic motor is lower than the predetermined pressure.

7. A shovel comprising:

a main pump;

hydraulic actuators including a swing hydraulic motor;

a control valve configured to control a flow of a working oil between the main pump and the hydraulic actuators; and a plurality of accumulators connected between the swing hydraulic motor and the control valve, wherein the plurality of accumulators include at least two accumulators having mutually different maximum release pressures, wherein, at a time of an operation of a hydraulic actuator other than the swing hydraulic motor, the working oil is released from a first accumulator to a driving side of the other hydraulic actuator, in a case in which a pressure on the driving side of the other hydraulic actuator is a predetermined pressure or higher, and the working oil is released from a second accumulator having a maximum release pressure lower than that of the first accumulator to the driving side of the other hydraulic actuator, in a case in which the pressure on the driving side of the swing hydraulic motor is lower than the predetermined pressure.

8. The shovel as claimed in claim 7, wherein each of the plurality of accumulators is configured to release the working oil to an upstream of the main pump.

9. A shovel comprising:

a main pump;

hydraulic actuators including a swing hydraulic motor;

a control valve configured to control a flow of a working oil between the main pump and the hydraulic actuators; and a plurality of accumulators connected between the swing hydraulic motor and the control valve, and configured to accumulate the working oil on a braking side of the swing hydraulic motor at a time of a swing deceleration, wherein the plurality of accumulators respectively include separate on-off valves, and a maximum release pressure is releasable from each of the plurality of accumulators, wherein the plurality of accumulators include at least two accumulators having identical maximum release pressures, wherein the on-off valves open and close according to a pressure of the working oil of the swing hydraulic motor, and wherein one of the plurality of accumulators accumulates the working oil from the swing hydraulic motor at a timing different from another one of the plurality of accumulators.

* * * * *